US007204707B2

(12) United States Patent
Kawase et al.

(10) Patent No.: US 7,204,707 B2
(45) Date of Patent: Apr. 17, 2007

(54) CONNECTOR IN WHICH FLOATING OF A FRONT PORTION IS CONTROLLED BY FITTING OF A MATING CONNECTOR

(75) Inventors: Koji Kawase, Tokyo (JP); Akira Kimura, Tokyo (JP); Toshiyuki Moritake, Tokyo (JP); Nobukazu Kato, Tokyo (JP); Kazushi Kamata, Aomori (JP)

(73) Assignees: Japan Aviation Electronics Industry, Limited, Tokyo (JP); JAE Hirosaki, Ltd., Hirosaki-shi, Aomori (JP)

( * ) Notice: Subject to any disclaimer, the term of this patent is extended or adjusted under 35 U.S.C. 154(b) by 0 days.

(21) Appl. No.: 11/184,501

(22) Filed: Jul. 19, 2005

(65) Prior Publication Data

US 2006/0019520 A1 Jan. 26, 2006

(30) Foreign Application Priority Data

Jul. 20, 2004 (JP) ..... 2004-211859
Nov. 2, 2004 (JP) ..... 2004-319357

(51) Int. Cl.
*H01R 13/64* (2006.01)

(52) U.S. Cl. ..... 439/247; 439/496; 439/497

(58) Field of Classification Search ..... 439/247, 439/248, 497, 496, 495
See application file for complete search history.

(56) References Cited

U.S. PATENT DOCUMENTS 6,206,712 B1 * 3/2001 Norizuki et al. ..... 439/247

FOREIGN PATENT DOCUMENTS

JP 10321290 12/1998
JP 2002093531 3/2002

* cited by examiner

*Primary Examiner*—Neil Abrams
(74) *Attorney, Agent, or Firm*—Collard & Roe, P.C.

(57) ABSTRACT

In a floating connector (101) including a fitting portion (20) and a fixed portion (40), a supporting mechanism (1) is connected to the fitting portion and the fixed portion to support the fitting portion to the fixed portion so that the fitting portion may float in a fitting direction (26) of a mating connector (102). A floating control mechanism (22, 25) is arranged between the fitting portion and the fixed portion. When the mating connector is not fitted to the floating connector, the floating control mechanism locks or inhibits the floating of the fitting portion. However, the floating control mechanism enables the floating of the fitting portion in response to a fitting operation of the mating connector to the floating connecter. Use of the mating connector causes motion of a slide plate (22) and rotation of a stopper (25) about an axis (25*a*, 13) and results in release of the fitting portion (20) to enable it to float in a selected direction. A metal ground plate (6) may be attached to the contact assembly and selected contacts (5) folded back to engage the ground plate (FIG. 5B).

6 Claims, 15 Drawing Sheets

CONNECTOR IN WHICH FLOATING OF A FRONT PORTION IS CONTROLLED BY FITTING OF A MATING CONNECTOR

This application claims priority to prior Japanese applications JP 2004-211859 and JP 2004-319357, the disclosures of which are incorporated herein by reference.

BACKGROUND OF THE INVENTION

This invention relates to a floating connector which can be used for connection with a SATA (Serial AT Attachment) connector of a hard disk drive or the like.

Heretofore, for connection with a SATA connector of a hard disk drive (HDD) or the like, use is made of a floating connector having a fitting portion movable in directions (X axis direction and Y axis direction) perpendicular to a fitting direction and perpendicular to each other. A floating connector of the type is disclosed, for example, in Japanese Unexamined Patent Application Publication (JP-A) No. H10-321290. Similarly, Japanese Unexamined Patent Application Publication (JP-A) No. 2002-93531 discloses a connector having a fitting portion displaceable in a width direction (X axis direction) and a height direction (Y axis direction).

Such an existing floating connector has a structure in which the fitting portion is freely movable in the X axis and the Y axis direction even in an unfitted state where it is not fitted to a mating connector. Thus, the fitting portion is held movable only by a contact. Therefore, if the fitting portion is subjected to mechanical shock, the fitting portion is moved to cause an adverse influence such as deformation of the contact.

SUMMARY OF THE INVENTION

It is therefore an object of this invention to provide a floating connector in which a fitting portion to be fitted with a mating connector is fixed in an unfitted state and is floatable after the mating connector is fitted.

It is another object of this invention to provide a floating connector of the type describe, in which a fitting portion is movable in X axis and Y axis directions intersecting with a fitting direction in response to a fitting operation with a mating connector.

It is still another object of this invention to provide a floating connector of the type describe, in which a fitting portion is movable in X axis, Y axis, and Z axis directions.

It is yet another object of this invention to provide a connector of the type described, which is capable of absorbing displacement or a positioning error after a mating connector is connected.

Other objects of the present invention will become clear as the description proceeds.

According to an aspect of the present invention, there is provided a floating connector which comprises a fitting portion, a fixed portion, a supporting mechanism connected to the fitting portion and the fixed portion to support the fitting portion to the fixed portion so that the fitting portion has a floating allowed in a first direction including a fitting direction of a mating connector, and a floating control mechanism between the fitting portion and the fixed portion for locking the floating when the mating connector is not fitted to the floating connector and for enabling the floating in response to a fitting operation of the mating connector to the floating connector.

DESCRIPTION OF THE PREFERRED EMBODIMENTS

Figure 1A:
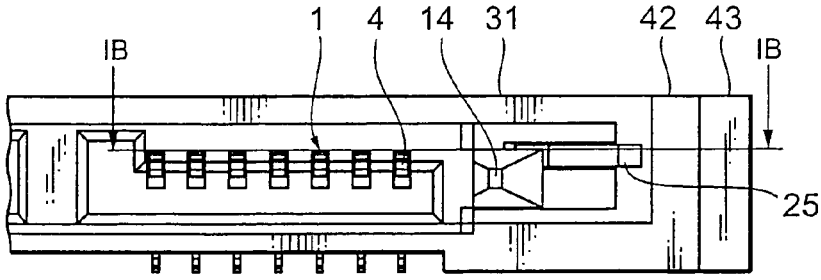
FIG. 1A is a partial front view of a floating connector according to a first embodiment of this invention.

Referring to FIGS. 1A to 6D, description will be made of a floating connector (hereinafter will be referred to as a first floating connector) according to a first embodiment of this invention.

The first floating connector is depicted by 101 and includes a fitting portion or a fitting portion insulator 20 having fitting portions 15 and 18 to be fitted to a mating connector 102 in a fitting direction 26, a movable portion or a movable insulator 30, and a fixed portion or a fixed insulator 40. In the fixed insulator 40, one end of a contact portion 10 is embedded. The fitting portion insulator 20 is provided with an L-shaped stopper 25 and a slide cam 22 disposed at its one end. The fitting direction 26 of the mating connector 102 and an opposite direction or a removing direction opposite to the fitting direction 26 may collectively be referred to as a first direction (Z axis direction) 28.

The fitting portion insulator 20 includes a fitting portion insulator body 11 comprising a box-like member having a ⊃-shaped section, and a pair of guides 12 formed on opposite sides thereof. On a front side of the fitting portion insulator body 11, the fitting portions 15 and 18 are formed. The fitting portions 15 and 18 have ceiling plates provided with grooves 16 and 17, respectively, for receiving end portions 4 of contacts 1 which will later be described in detail.

In the illustrated example, the contact portion 10 is formed only on one side of the fixed insulator 40. However, a similar contact portion may additionally be formed on the other side of the fixed insulator 40.

The movable insulator 30 has a box-like shape adapted to receive the fitting portion insulator 20 in its interior. The movable insulator 30 includes a movable insulator body 31 having a receiving portion 32 opened forward, and a pair of L-shaped floating engaging members 34 formed on opposite sides of the movable insulator body 31 at its rear end. The engaging members 34 protrude rearward, perpendicularly bend, and extend outward. Between the movable insulator body 31 and each of the engaging members 34, an engaging groove 35 is formed to penetrate in a second direction 36 as a vertical direction (Y axis direction) and to open outward in a third direction 37 as a widthwise direction (X axis direction).

The fixed insulator 40 has a substantial U shape and includes a fixed insulator body 41 extending in the third direction 37, a pair of first floating guide members 42 formed on opposite side of the fixed insulator body 41 to extend in the third direction 37 and to extend and stand in the second direction 36, and a pair of second floating guide members 43 of a flat shape formed outside the first floating guide members 42, respectively, and extending in the second direction 36 and the first direction 28. The fixed insulator body 41 has a step portion 45 formed by slightly cutting a rear part thereof and a step portion 44 depressed upward from its bottom surface.

The contact portion 10 includes the contacts 1 arranged in parallel to one another, a flexible flat insulator 7 supporting a part of each contact 1, and a metal plate 6 (FIGS. 6A to 6D) covering a back surface of the insulator 7. Thus, the insulator 7 is interposed and clamped between the contacts 1 and the metal plate 6. A part of the insulator 7 is disposed at base portions 3 of the contacts 1. The insulator 7 has a holding portion disposed at supporting portions 2 of the contacts 1.

As illustrated in FIGS. 6A to 6D, the metal plate 6 comprises a metal thin plate. The metal plate 6 has protruding portions 6*a* attached to the fixed insulator body 41.

Figure 5A:
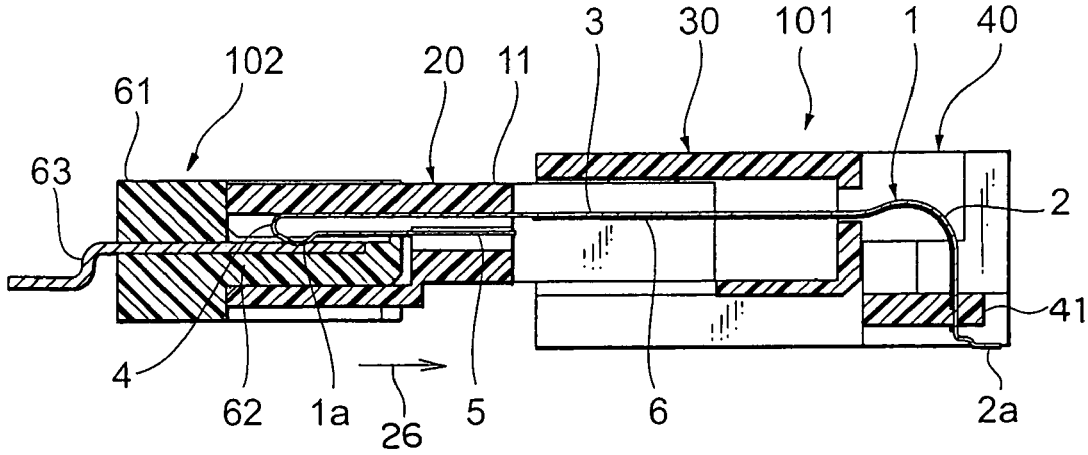
FIG. 5A is a sectional view taken along a line VA—VA in FIG. 4B.
Figure 5B:
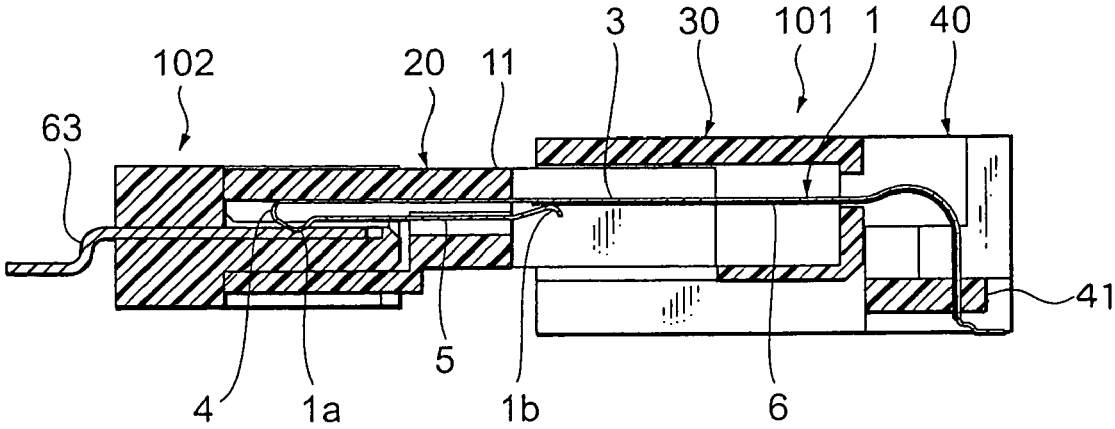
FIG. 5B is a sectional view taken along a line VB—VB in FIG. 4B.
Figure 6A:
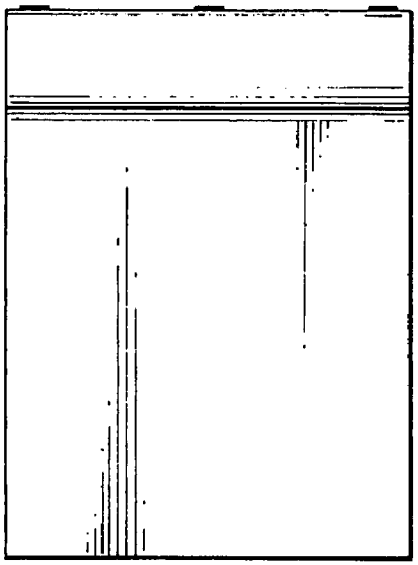
FIG. 6A is a plan view of a metal plate contained in the floating connector in FIG. 1A.
Figure 6B:
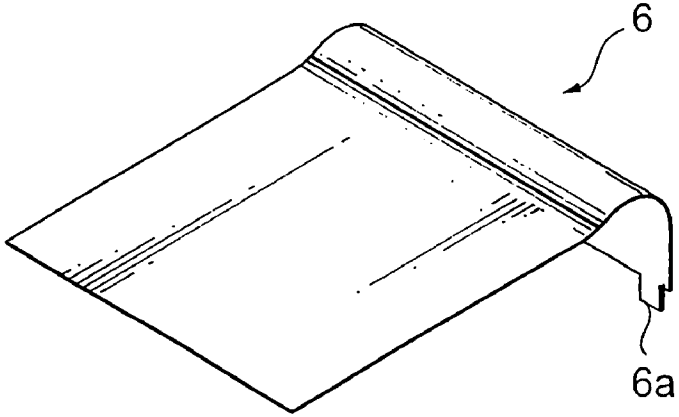
FIG. 6B is a perspective view of the metal plate illustrated in FIG. 6A.
Figure 6C:
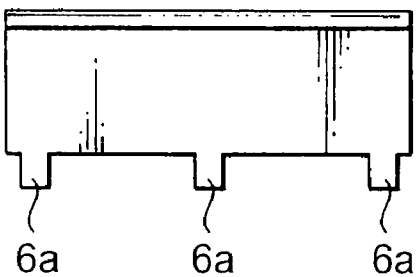
FIG. 6C is a front view of the metal plate illustrated in FIG. 6A.
Figure 6D:
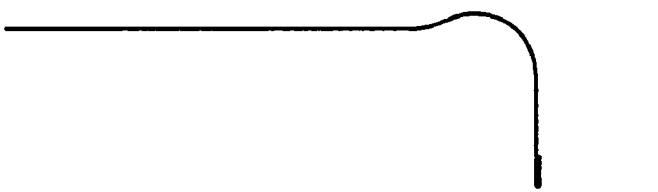
FIG. 6D is a side view of the metal plate illustrated in FIG. 6A.

In case where the first floating connector 101 is used as a high-speed transmission connector for a SATA connector of a HDD or the like, impedance matching of the contacts 1 is achieved by attaching the metal plate 6, which serves as a ground, to the contacts 11 arranged in parallel with the insulator 7 interposed therebetween. In FIGS. 5A and 5B, the insulator 7 is not illustrated because the insulator 7 is substantially similar in shape to the metal plate 6.

Figure 1B:
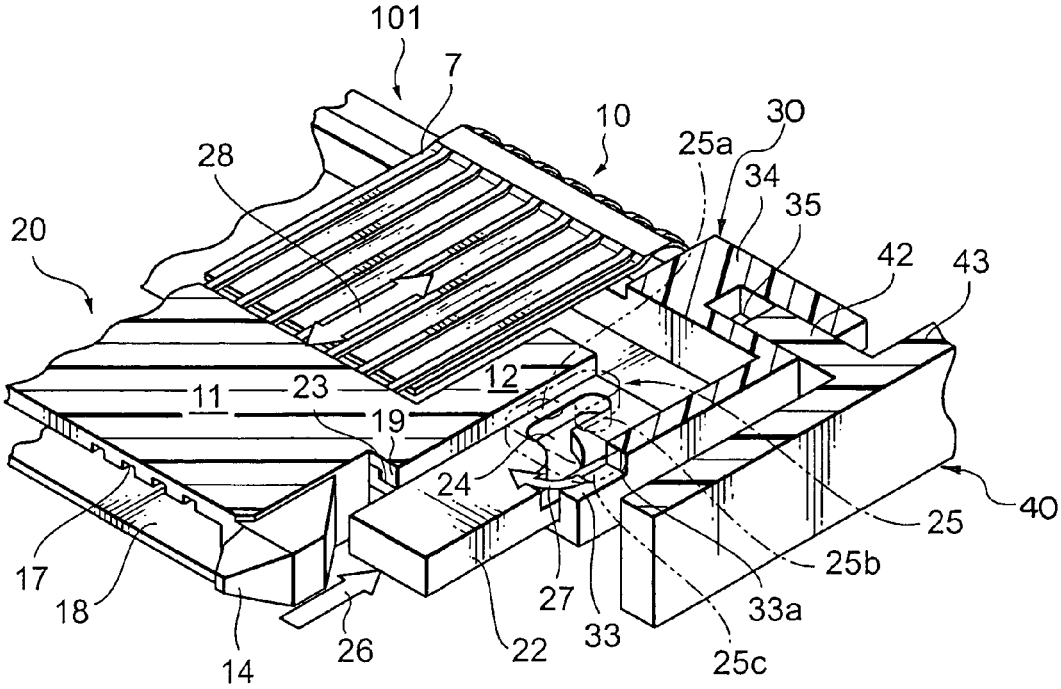
FIG. 1B is a sectional perspective view taken along a line IB—IB in FIG. 1A.
Figure 2:
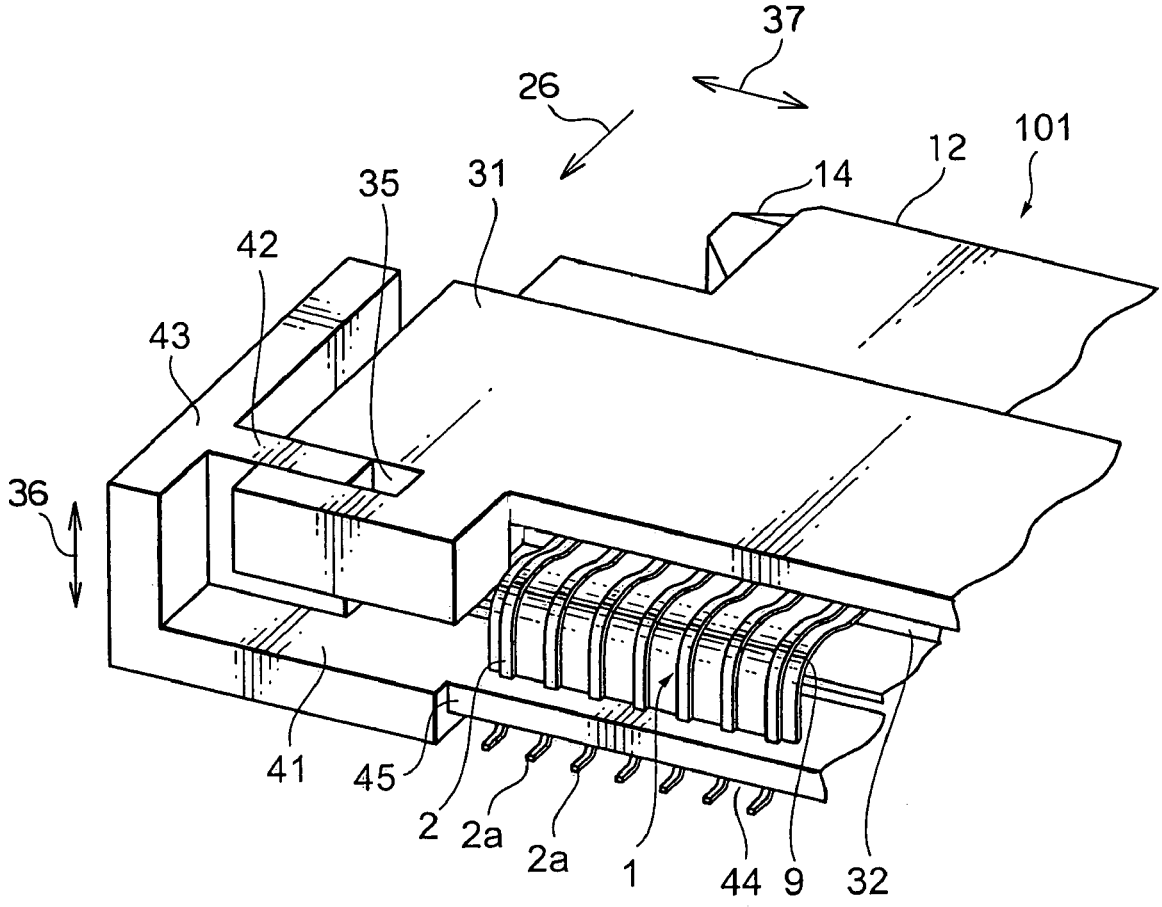
FIG. 2 is a perspective view of the floating connector illustrated in FIG. 1A.
Figure 3:
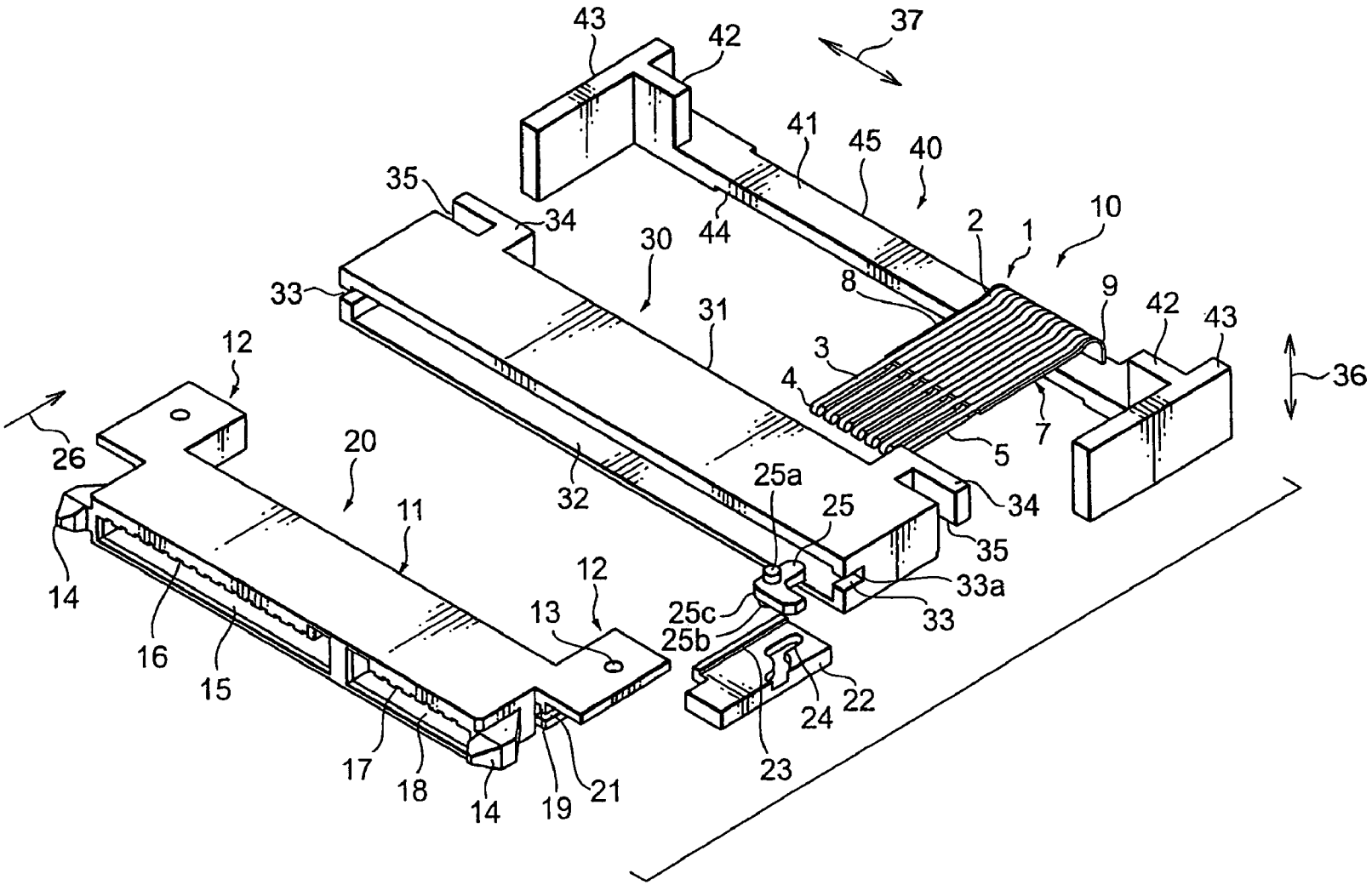
FIG. 3 is an exploded perspective view from a rear side of the floating connector illustrated in FIG. 1A.

As shown in FIGS. 1 to 3, each of the contacts 1 has the arc-shaped supporting portion 2, the base portion 3 extending therefrom, an end portion 4 where the contact 1 is folded back, and a folded portion 5 extending rearward.

As best shown in FIGS. 5A and 5B, a contacting portion 1*a* roundly protruding downward is formed between the end portion 4 and the folded portion 5 of the contact 1. The base portion 3 near the end portion 4 of the contact 1 and the folded portion 5 of the contact 1 are held by the fitting portion insulator body 11 of the fitting portion insulator 20. Herein, the contact 1 illustrated in FIG. 5A is a signal contact. The contact 1 illustrated in FIG. 5B is a ground contact and has an end 1*b* of the folded portion 5 contacted with the metal plate 6.

On the other hand, the arc-shaped supporting portion 2 is planted on one side of the fixed insulator body 41. In detail, the supporting portion 2 extends through the fixed insulator body 41 of the fixed insulator 40 in the second direction 36 and bends towards the fitting direction 26 to forms a terminal portion 2*a* at a lower end of the connector. Each contact 1 of the contact portion 10 is fixed to the fitting portion insulator 20 and the fixed insulator 40. The contacts 1 serve as a supporting mechanism.

So as to allow the fitting portion insulator 20 to be easily movable, the thickness of the contact 1 is reduced. In addition, an unfixed part of the contact 1 is longer than a fixed part so that the contact 1 is given flexibility. Because the thickness is reduced to give the flexibility to the contact 1, a contacting force with a mating contact 63 of a mating connector 102 of the HDD or the like (not shown) is decreased. Accordingly, in order to increase the contacting force, each contact 1 is folded back at the end portion 4, namely, at its end near the fitting portions 15 and 18 of the connector and both of the base portion 3 and the folded portion 5 are fixed to the fitting portion insulator body 11. Thus, by the use of the contact 1 having such a double structure, it is possible to increase a spring constant of the contact 1 so as to increase the contacting force.

In order to establish connection between the mating contact 63 and ground, the folded portion 5 of the contact 1 is provided with the contacting portion 1*a* having elasticity as described above. In this manner, the metal plate 6 (FIG. 5B) disposed on a lower side of the contact 1 and serving as the ground is connected to the contacting portion 1*b* of the contact 1.

A stopper 25 serves to inhibit (lock) movement of the fitting portion insulator 20 with respect to the movable insulator 30 in the fitting direction 26. The stopper 25 has a plate member 25*c* of an L shape, a rotation shaft 25*a* formed at an approximate center of the L shape and protruding upward, and a guide shaft 25*b* protruding downward from one end of the L shape. Thus, the guide shaft 25*b* is located at an eccentric position with respect to the rotation shaft 25*a*. The rotation shaft 25*a* is inserted into an axial hole 13 of a guide member 12. On the other hand, the guide shaft 25*b* is inserted into a cam groove 24 formed on one surface of the slide cam 22.

The slide cam 22 has a guide groove 23 penetrating along the one surface of the slide cam 22 in the first direction 28, and the cam groove 24. The cam groove 24 has a straight portion extending in the first direction 28 and a generally S-shaped portion extending outward from an end of the straight portion in a curved shape to reach the outside.

As illustrated in FIGS. 1A and 1B, a rib (rail) 19 formed inside the guide member 12 of the fitting portion insulator 20 is fitted to the guide groove 23 of the slide cam 22. Further, the rotation shaft 25*a* on the one surface of the stopper 25 is fitted to the axial hole 13 of the guide member 12. The guide shaft 25*b* formed at the one end on the other surface of the stopper 25 is fitted to the cam groove 24 of the slide cam 22. A combination of the stopper 25 and the slide cam 22 serves as a floating control mechanism for performing a locking of the movement of the fitting portion insulator 20 and for releasing the locking.

When the slide cam 22 is located on a side opposite to the fitting direction 26 of the mating connector 102, a part or a whole of the stopper 25 enters into the movable insulator 30.

Referring to FIG. 3 again, description will be made of assembling of the first floating connector 101.

At first, from the above of the fixed insulator 40, the first floating guide members 42 are fitted to the engaging grooves 35 on the rear side of the movable insulator 30. Next, the contact portion 10 is inserted into the receiving portion 32.

To the guide member 12 of the fitting portion insulator 20, the slide cam 22 is fitted by the use of the rib 21 and the guide groove 23. Then, the rotation shaft 25*a* of the stopper 25 is inserted into the axial hole 13 of the guide member 12. The guide shaft 25*b* of the stopper 25 is inserted into the cam groove 24 of the slide cam 22. In this state, a rear end of the fitting portion insulator 20 is received in the receiving portion 32 of the movable insulator 30. At this time, the end portions 4 of the contacts 1 are press-fitted into the grooves 17 of the fitting portion 18, respectively. As described above, the contacts 1 are fixed to the fixed insulator 40 and the fitting portion insulator 20 at their portions near its forward and rear ends. In this manner, the floating connector 101 is completed as illustrated in FIGS. 1A and 1B.

Next, description will be made of a fitting operation of the mating connector 102.

Before fitting of he mating connector 102, for example, the SATA connector of the HDD, the stopper 25 is brought into contact with a bottom portion 33*a* of a groove 33 formed at a side portion of the movable insulator 30. Therefore, the fitting portion insulator 20 of the floating connector 101 is unmovable with respect to the fixed insulator 40 in the fitting direction 26.

However, in the second direction 37 and the third direction 36 illustrated in FIG. 2, the fitting portion insulator 20 is movable, i.e., floatable. Movable insulator 30 and fitting portion insulator 20 are jointly movable in second direction 36 and third direction 37 with respect to fixed insulator 40, and release of stopper 25 allows fitting portion insulator 20 to float in fitting direction 26. It is noted here that, when the mating connector 102 is not connected, the movable insulator 30 is fixed to the fitting portion insulator 20 and, therefore, the fitting portion insulator 20 is inhibited from movement in the first direction 28 even if mechanical shock is given.

Figure 4A:
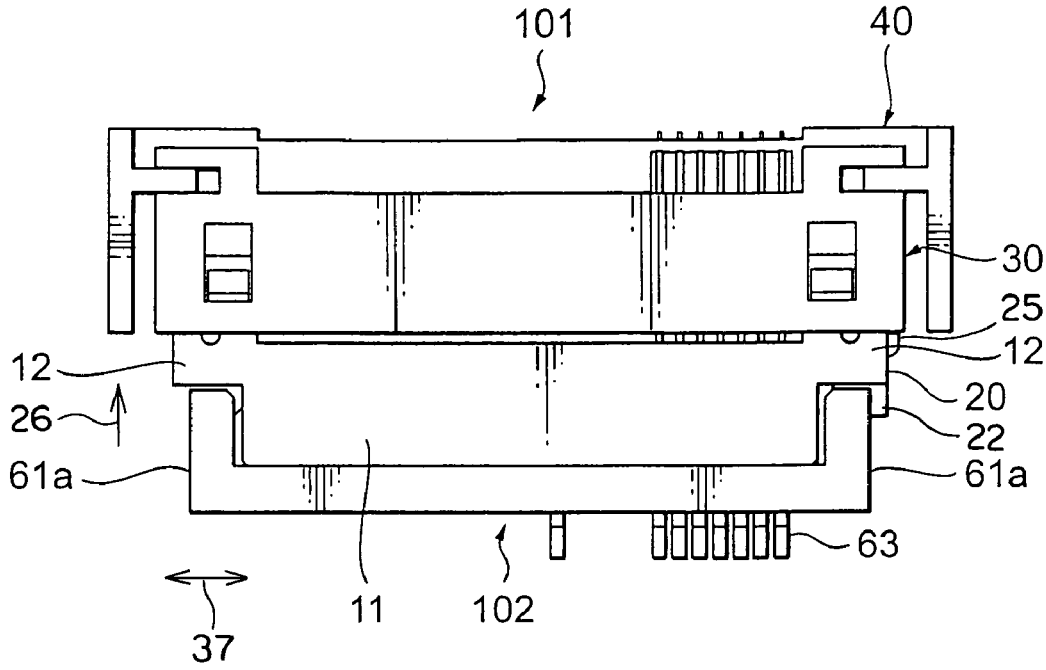
FIG. 4A is a plan view showing a fitted state of the floating connector in FIG. 1A and a mating connector.
Figure 4B:
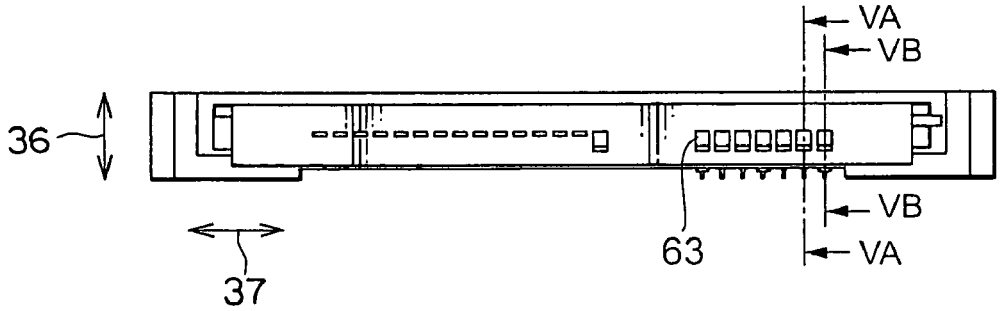
FIG. 4B is a front view showing the fitted state.
Figure 4C:
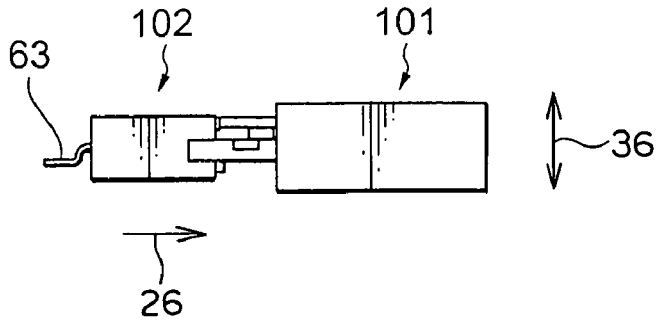
FIG. 4C is a side view showing the fitted state.

Next, in a fitted state illustrated in FIG. 4A, one end 61*a* of the mating connector 102 pushes one end of the slide cam 22 in the fitting direction 26. Then, the guide shaft 25*b* moves forward in the cam groove 24 with respect to the slide cam 22 to rotate the stopper 25 as depicted by an arrow 27 in FIG. 1B. Consequently, one end portion of the stopper 25 is rotated and disengaged from the movable insulator 30. Therefore, the fitting portion insulator 20 is floatable in the first direction 28. After the mating connector 102 is fitted, it is still possible to absorb displacement or a positioning error of the mating connector 102 in the second direction 36 and the third direction 37. Thus, when the mating connector 102 is fitted, the slide cam 22 is pressed by the mating connector 102 to rotate the stopper 25 so that the movable insulator 30 is unlocked. Accordingly, the movable insulator 30 is fixed in an unfitted state and, after fitting, the movable insulator 30 is allowed to move.

In the first floating connector 101, the fitting portion insulator 20 is fixed until fitting with the mating connector 102 is completed. After completion of fitting, the fitting portion insulator 20 is unlocked to be floatable in the connector fitting direction 26. Thus, the movable insulator 30 is freely floatable in the first, the second, and the third directions 28, 36, and 37.

In the first floating connector 101, it is possible, even by the use of the same components, to accommodate different connector mounting heights merely by changing a bent shape of the contact.

Referring to FIGS. 7 to 17, description will be made of a floating connector according to a second embodiment of this invention (hereinafter will be referred to as a second floating connector). Similar parts are designated by like reference numerals, and the fitting operation proceeds in the manner hereinabove described.

The second floating connector is depicted by 103. The second floating connector 103 includes a fitting portion insulator 20, a fixed insulator 40 for receiving the fitting portion insulator 20 inserted therein, a pair of slide cams 22 disposed on opposite sides of the fitting portion insulator 20 to be faced to and symmetrical with each other, a pair of stoppers 25 disposed on opposite sides of the fitting portion insulator 20 to be faced to and symmetrical with each other, and a contact portion (not shown). The contact portion is similar in structure to the contact portion 10 of the first floating connector 101 and, therefore, illustration thereof is omitted.

The second floating connector 103 is different from the first floating connector 101 in that the movable insulator 30 is omitted, or that the movable insulator 30 and the fixed insulator 40 are integrally formed. At any rate, the fixed insulator is depicted by the same reference numeral 40.

Figure 14:
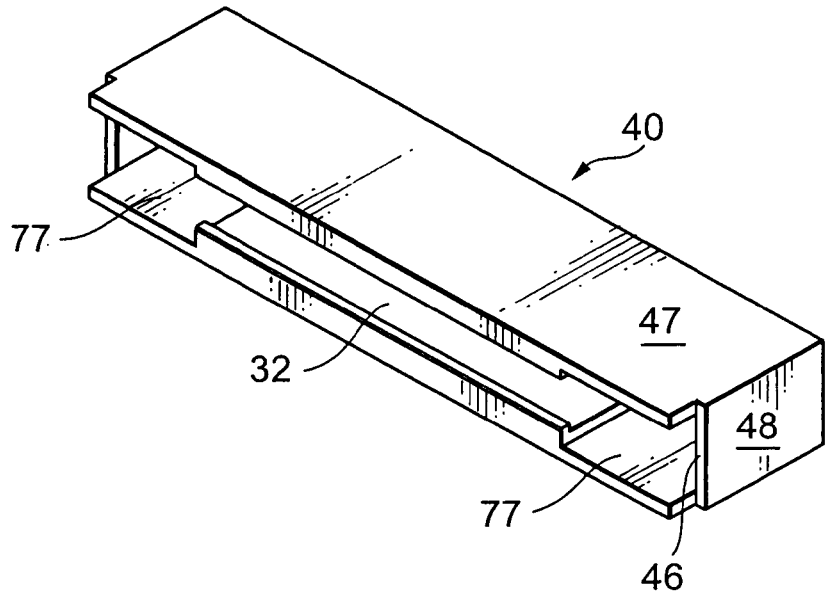
FIG. 14 is a perspective view of a fixed insulator contained in the floating connector in FIG. 7.

As illustrated in FIG. 14, the fixed insulator 40 has a box-like shape having a bottom plate 47 and a pair of side plates 48. The fixed insulator 40 has a pair of guide receiving portions 77 formed on opposite sides thereof on its front side, and a receiving portion 32 formed between the guide receiving portions 77 and narrowed in height. Each of the side plates 48 has a front end face to be brought into contact with the stoppers 25 which will later be described in detail.

Figure 15:
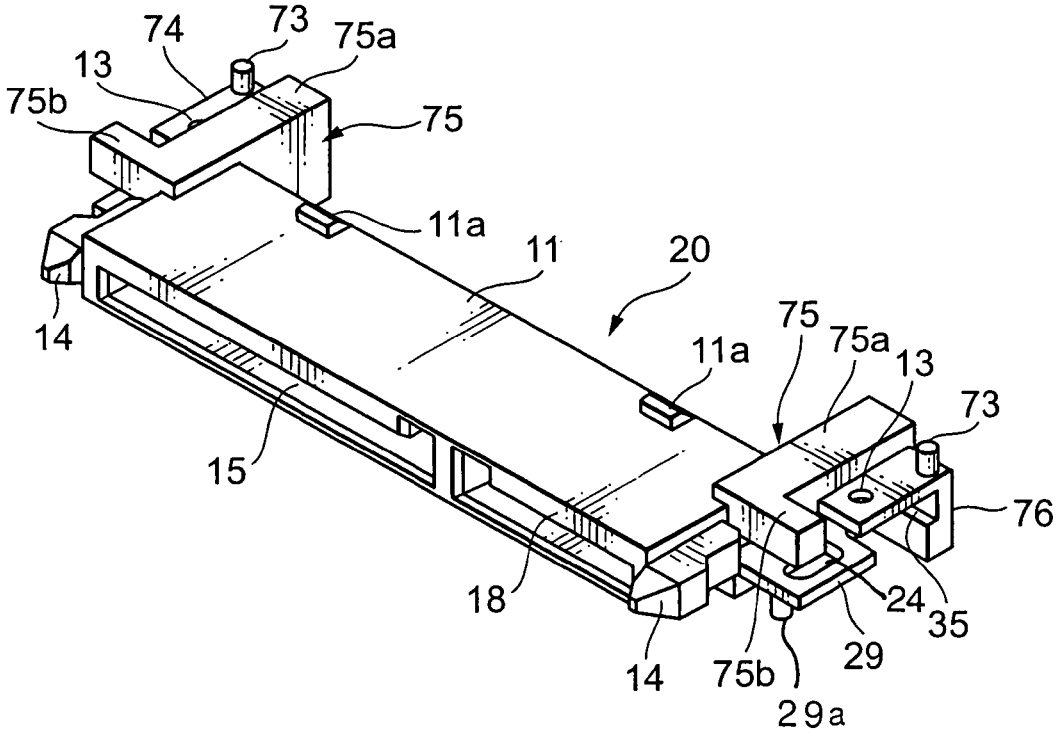
FIG. 15 is a perspective view of a fitting portion insulator contained in the floating connector in FIG. 7.

As best shown in FIG. 15, the fitting portion insulator 20 includes a fitting portion insulator body 11, a pair of columnar insertion guides 14 disposed on opposite sides of the fitting portion insulator body 11 and having sharp ends protruding forward, a pair of generally L-shaped first guides 75 formed on the opposite sides rearward of the insertion guides 14, a pair of second guides 76 having a generally L-shaped section and formed on the opposite sides rearward of the first guides 75, and a pair of plate-like third guides 29.

Figure 10:
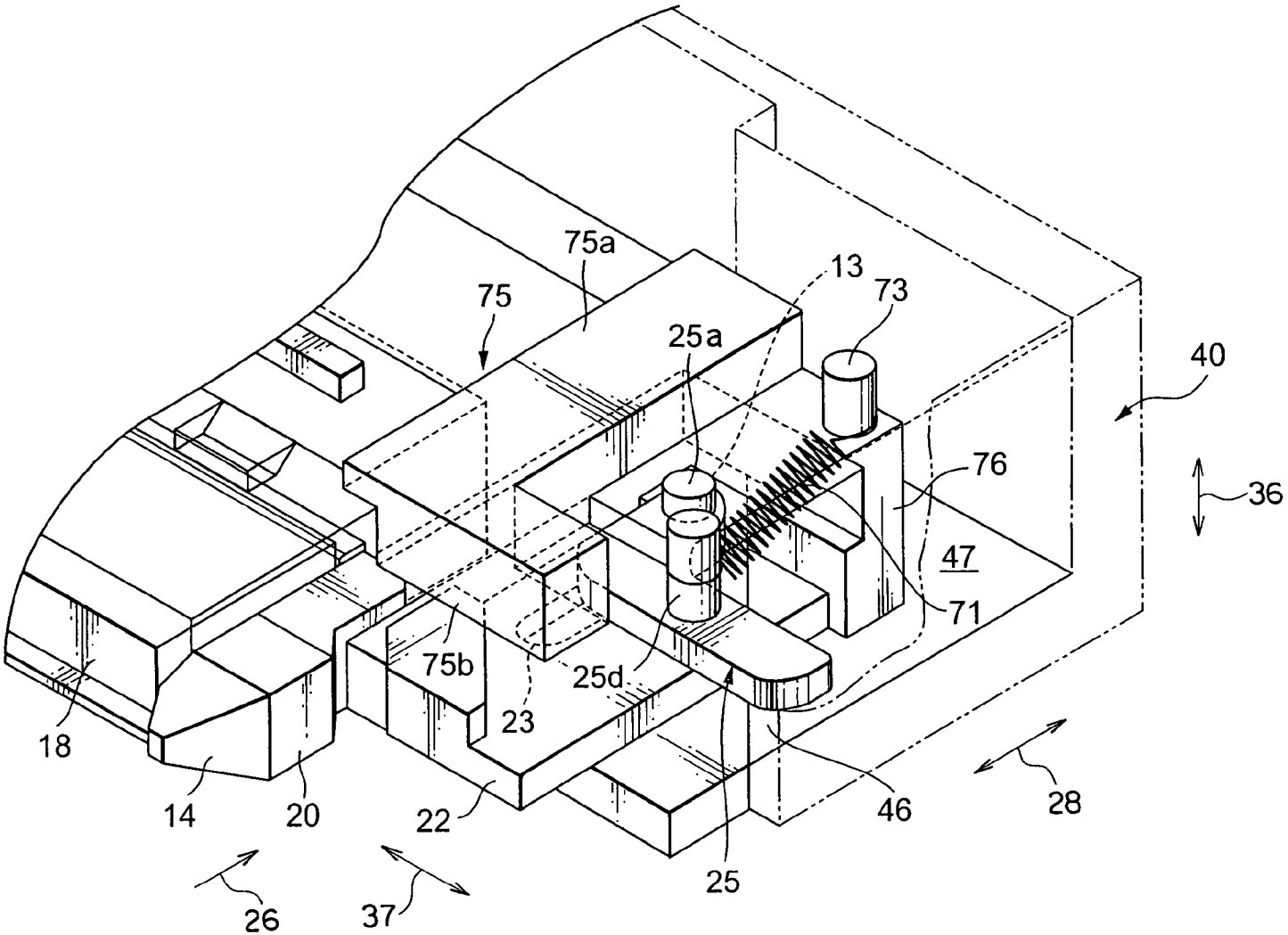
FIG. 10 is an enlarged partial perspective view of the floating connector in FIG. 7 in the state where the ceiling plate is removed therefrom.

Referring to FIG. 10, each of the stoppers 25 is inserted into a space defined by the first through the third guides 75, 76, and 29. Below the stopper 25, the slide cam 22 is inserted. The second guide 76 has a cylindrical protrusion 73 protruding upward.

Figure 13:
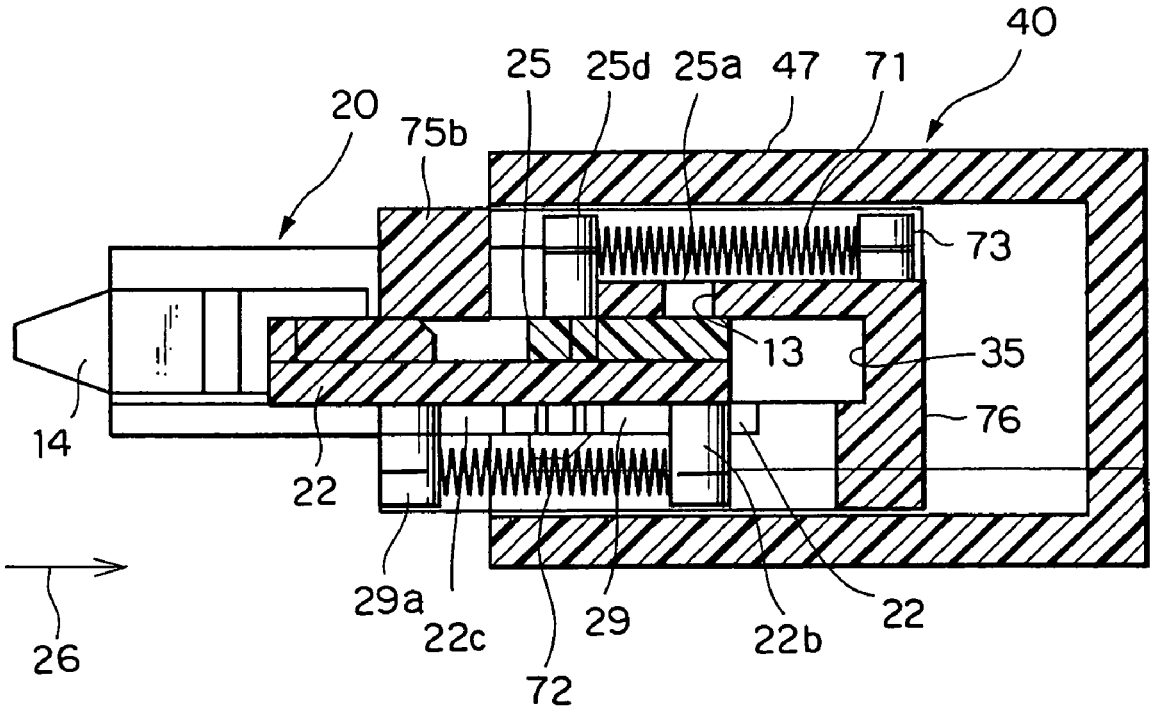
FIG. 13 is a sectional view of the floating connector in FIG. 7.
Figure 17:
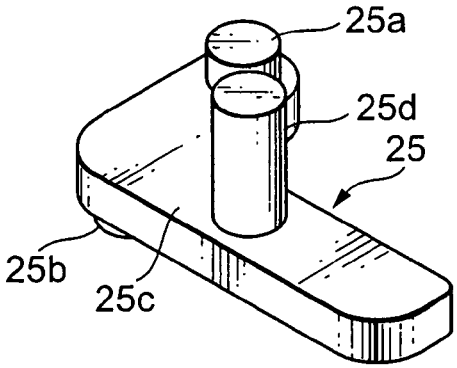
FIG. 17 is a perspective view of a stopper contained in the floating connector in FIG. 7.

As illustrated in FIG. 17, the stopper 25 has an L shape. The stopper 25 has a cylindrical rotation shaft 25*a* and a protrusion 25*d* on its one surface and a cylindrical guide shaft 25*b* formed on the other surface. As best shown in FIG. 13, the rotation shaft 25*a* on the one surface of the stopper 25 is inserted into an axial hole 13 formed on a ceiling plate of the second guide 76. Between the protruding portion 25*d* of the stopper 25 and the protruding portion 73, a coil spring 71 is formed to pull the stopper 25 towards the second guide 76.

Figure 16A:
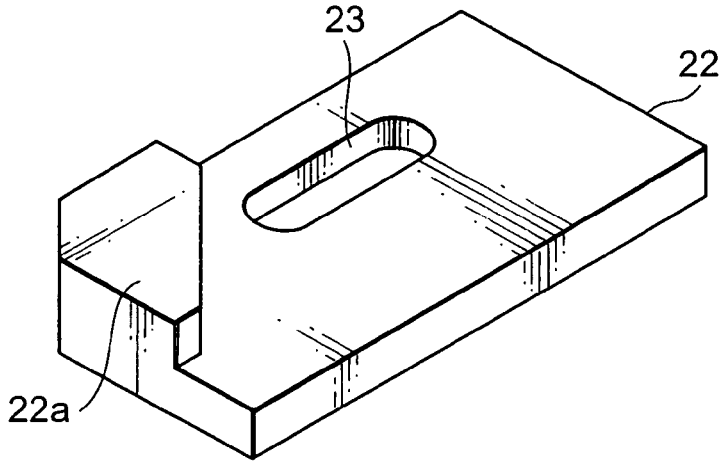
FIG. 16A is a perspective view of a slide cam contained in the floating connector in FIG. 7.
Figure 16B:
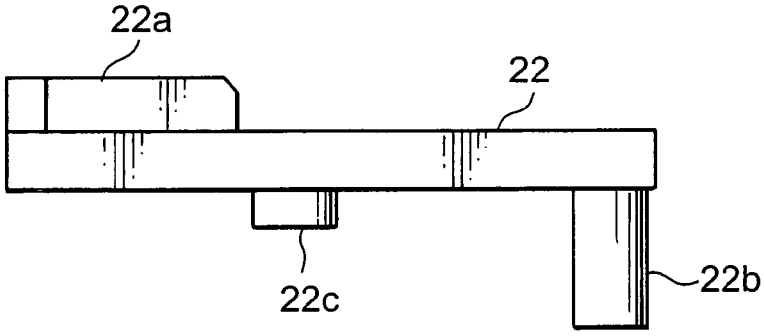
FIG. 16B is a side view of the slide cam in FIG. 16A.

As shown in FIGS. 16A and 16B, the slide cam 22 comprises an elongated rectangular plate with its one corner cut away and has a trapezoidal portion 22*a* protruding upward and having a trapezoidal upper surface 22*a* guided by first guide 75. The slide cam 22 has a long guide groove 23 extending in its longitudinal direction. Further, the slide cam 22 has a protruding portion 22*c* formed at the center of its lower surface and protruding downward, and a cylindrical protrusion 22*b* formed on the lower surface at an end opposite to the trapezoidal portion 22*a* and protruding downward. The guide shaft 25*b* of the stopper 25 is inserted into the long hole 23 of the slide cam 22.

As shown in FIGS. 11 to 13 and 15, the third guide 29 comprises a plate member integral with the first and the second guides 75 and 76. The third guide 29 has an L-shaped cam groove 24 for guiding formed at its center as a through hole, and a protruding portion 29*a* formed on a front side and protruding downward. The protruding portion 22*c* of the slide cam 25 is inserted into the L-shaped cam groove 24 of the third guide 29. Between the cylindrical protruding portion 29*a* of the third guide 29 and the protruding portion 22*b* of the slide cam 22, a spring 72 is formed to urge the slide cam 29 forward.

Thus, by the two coil springs 71 and 72, the fitting portion insulator 40 and the fixed insulator 20 having the stoppers and the slide cams are balanced and are always located at a predetermined position in the state where a mating connector (not shown) is not fitted.

Figure 7:
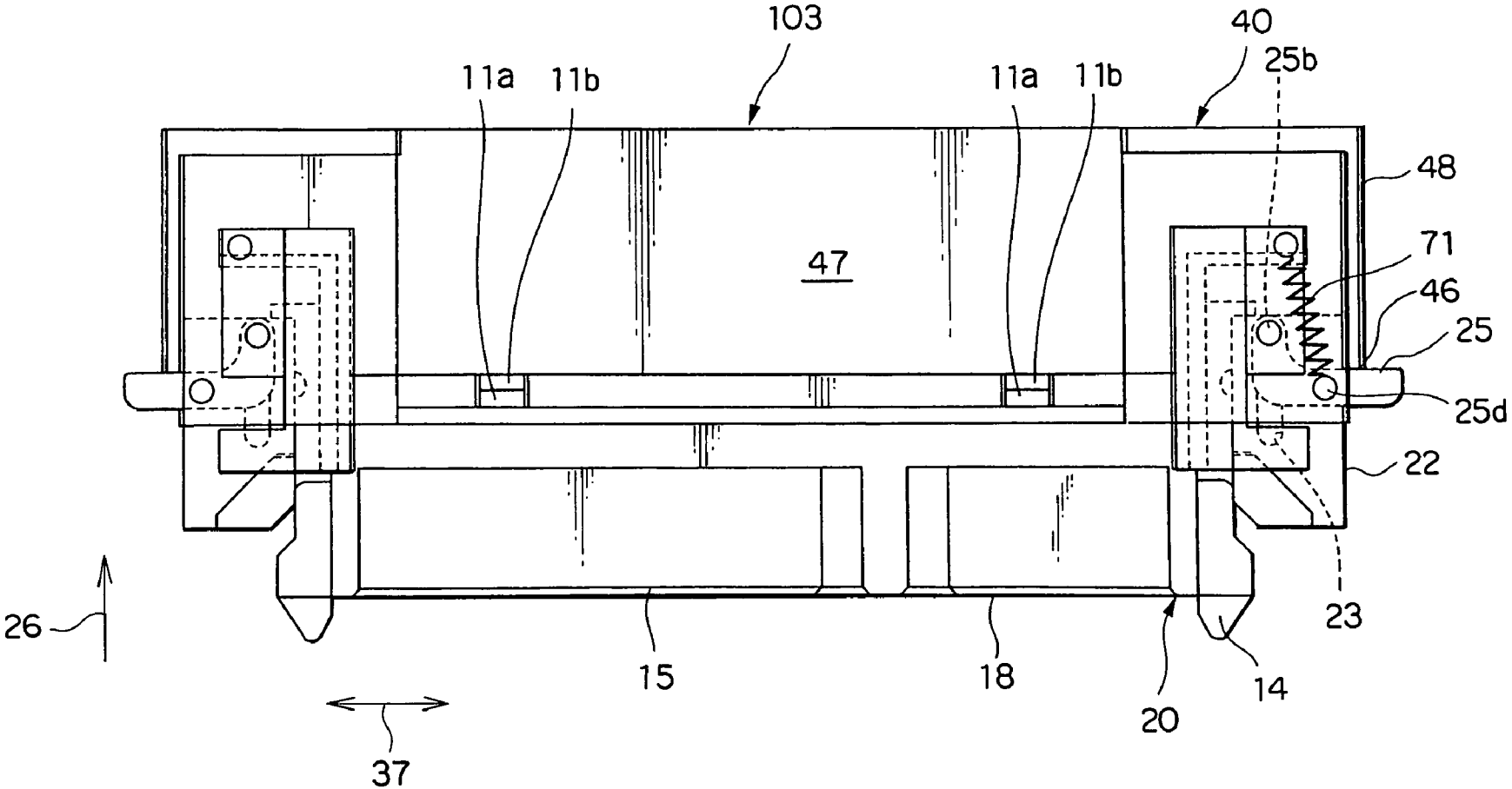
FIG. 7 is a plan view of a floating connector according to a second embodiment of this invention in the state where a ceiling plate is removed therefrom.
Figure 8:
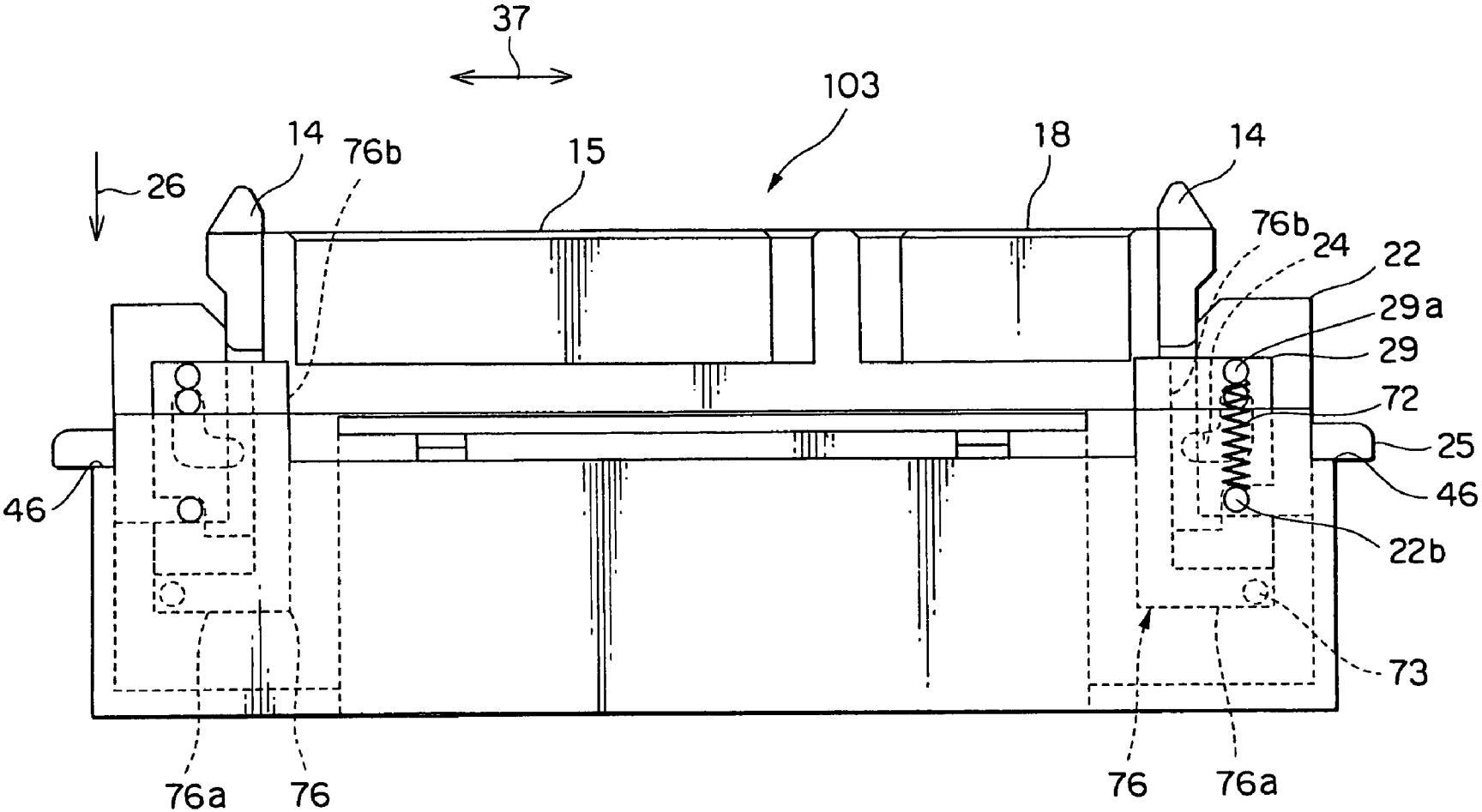
FIG. 8 is a bottom view of the floating connector in FIG. 7.
Figure 9:
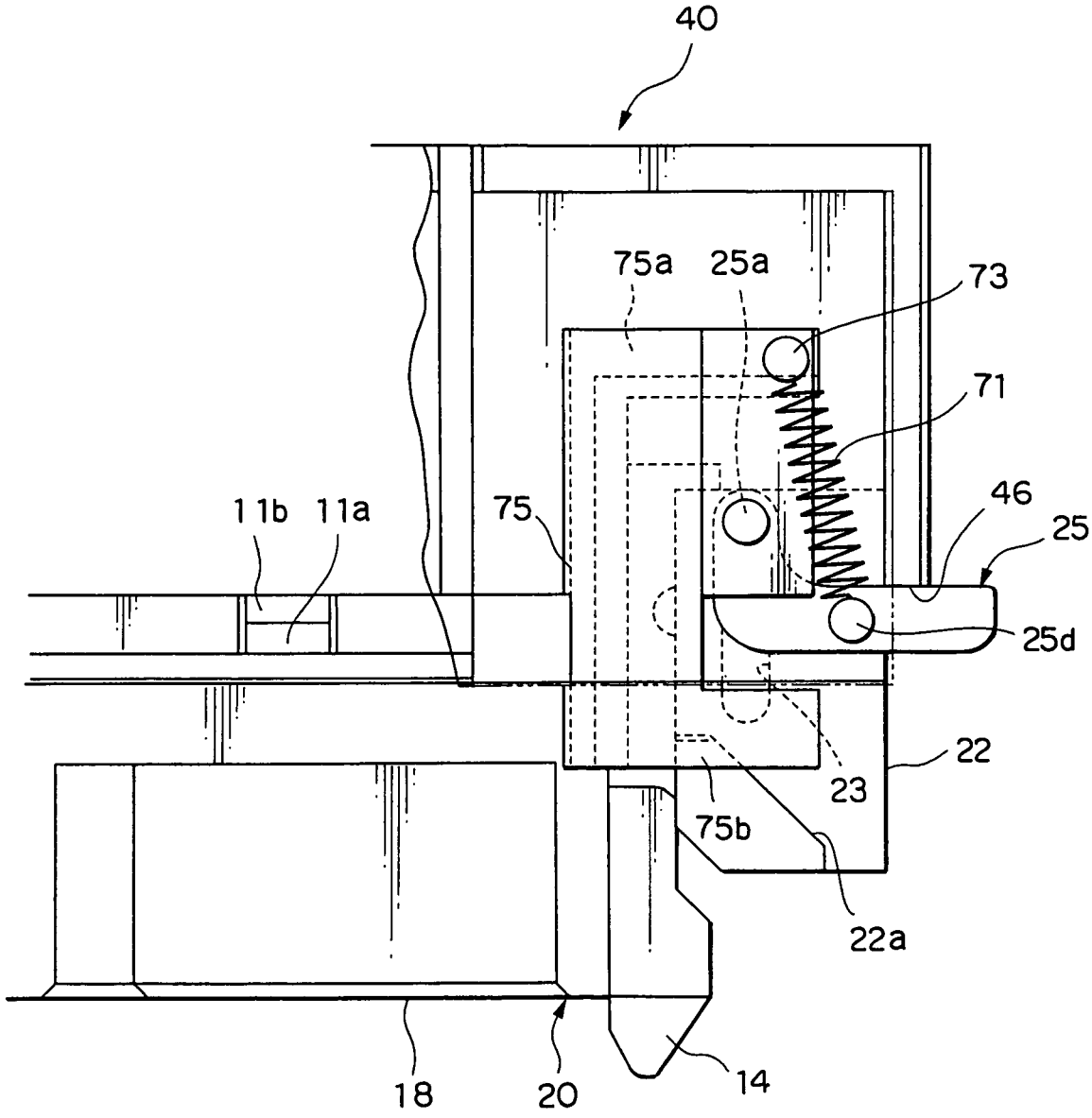
FIG. 9 is an enlarged partial plan view of the floating connector in FIG. 7.

In order to assemble the second floating connector 103, the slide cams 22 illustrated in FIG. 16 and the stoppers 25 illustrated in FIG. 17 are attached to the fitting portion insulator 20 illustrated in FIG. 15. Thereafter, the coil springs 71 and 72 are attached to the fitting portion insulator 20. Then, the fitting portion insulator 20 is fitted to the fixed insulator 40 from the rear side. Thus, the second floating connector 103 illustrated in FIG. 7 is completed.

Next, description will be made of an operation of the second floating connector 103.

Herein, a fitting direction and a removing direction opposite thereto are collectively called a first direction (Z axis direction) 28. A vertical direction is called a second direction (X axis direction) 36. A widthwise direction is called a third direction (Y axis direction) 37. In this event, in the second floating connector 103, the fitting portion insulator 20 is always movable with respect to the fixed insulator 40 in the vertical direction, i.e., the second direction 36.

Figure 11:
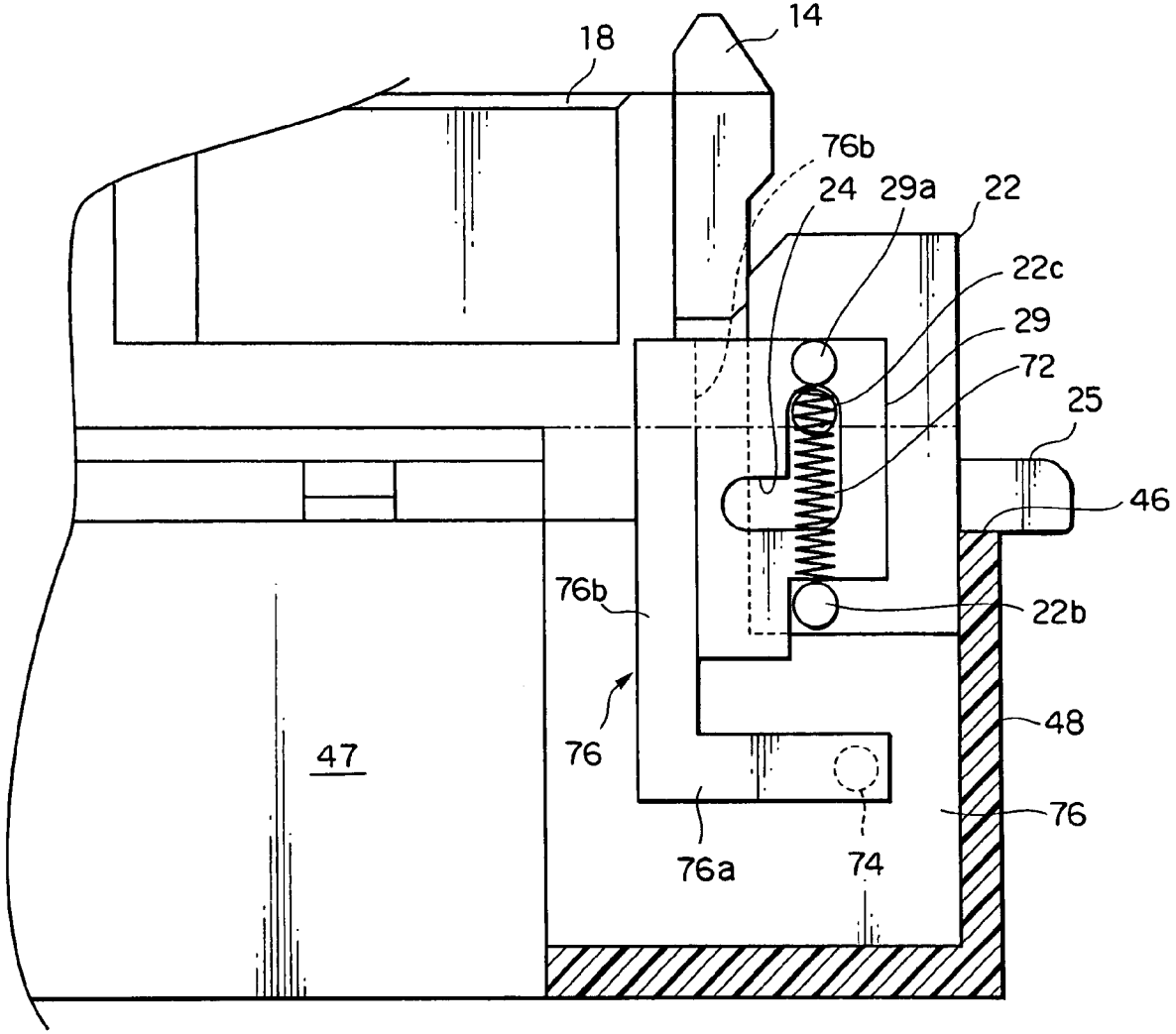
FIG. 11 is an enlarged partial plan view, partly in section, of the floating connector in FIG. 8 in the state where the ceiling plate is removed therefrom.
Figure 12:
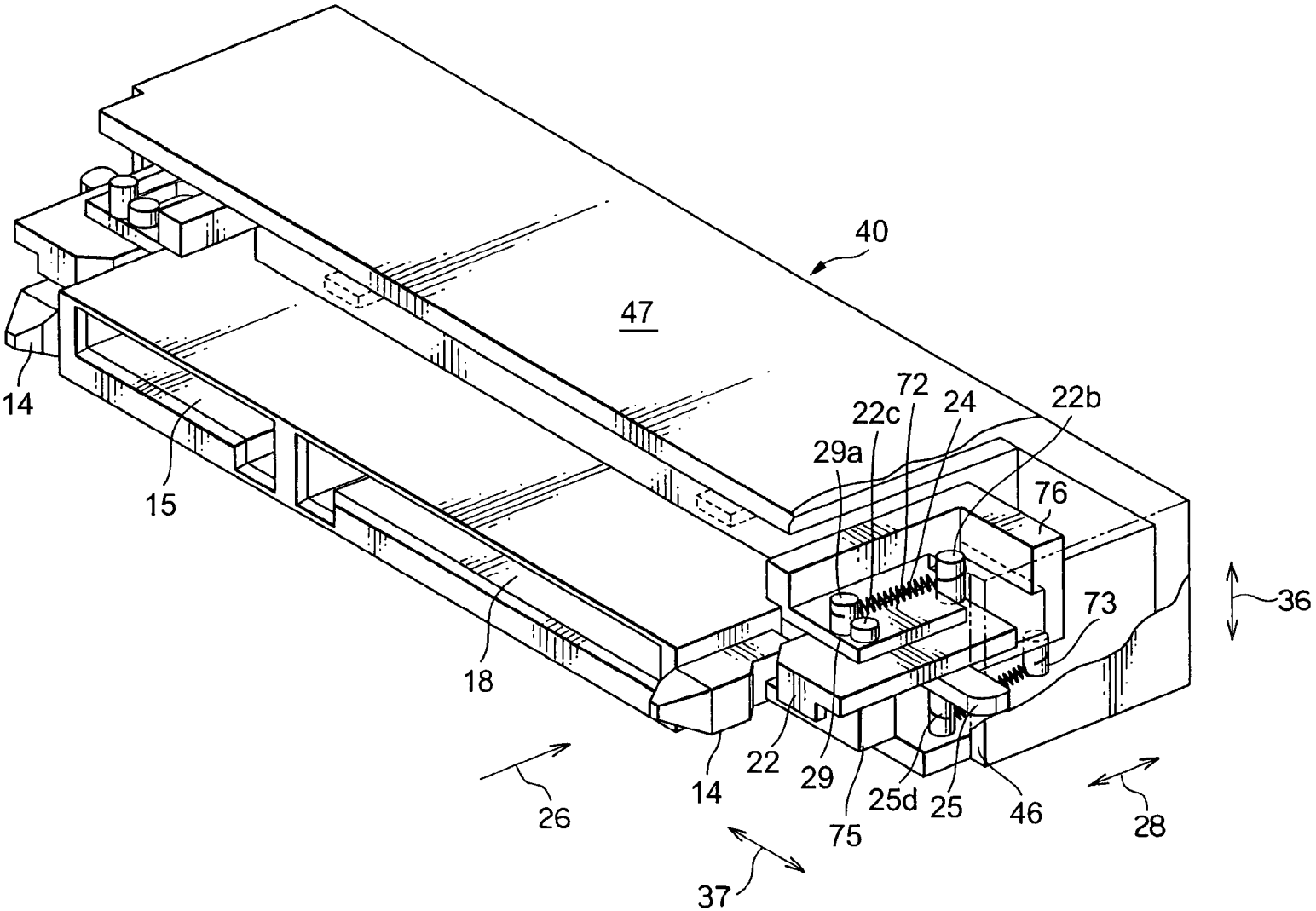
FIG. 12 is a bottom perspective view of the floating connector in FIG. 7.

As illustrated in FIGS. 7 to 13, in the state where each stopper 25 is brought into contact with each of side end faces 46 of the fixed insulator 40, one shaft of the stopper 25 is inserted into the ceiling plate 76*a* of the second guide 76 so that the fitting portion insulator 20 is not moved in the fitting direction 26. Since the slide cams 22 are formed on the opposite sides, the fitting portion insulator 20 is also unmovable with respect to the fixed insulator 40 also in the third direction 37 as the widthwise direction. When the second floating connector 103 is fitted to the mating connector (not shown), an end portion of the mating connector is brought into contact with a forward end of each slide cam 22 50 that the slide cam 22 is pushed rearward against a restoring force of the coil spring 72. When the slide cam 22 is pushed rearward, the protruding portion 22*c* protruding downward from the slide cam 22 illustrated in FIG. 11 is moved along the cam groove 24 in the first direction 28 to a cross point of the L shape of the cam groove 24. In this state, the slide cam 22 is movable along the cam groove 24 in the third direction 37. Therefore, the fitting portion insulator 20 is movable in the third direction 37 with respect to the fixed insulator 40. When the fixed insulator 40 is pulled out in the above-mentioned state, the fitting portion insulator 20 and the mating connector are released from each other into the unfitted state again.

If the stopper 25 is rotated counterclockwise and unlocked in the fitted state, the fixed insulator 40 and the fitting portion insulator 20 are movable in the first direction 28. The fitting portion insulator 20 exerts a force to push the slide cam 22 inward when the stopper 25 is rotated. The stopper 25 positions the slide cam 22 in the second direction 36. Thus, a position of the slide cam 22 at which the slide cam 22 is contacted with the fixed insulator 40 and a position at which the slide cam 22 is received inside are determined by a rotating position of the stopper 25. This stopper position is determined by a spring force of the coil spring 71.

Upon fitting with the mating connector, the slide cam 22 is pushed by an insertion force greater than a fixing force of the coil spring 71. This enables the fitting portion insulator 20 to float in either the first direction 28, the second direction 36, and the third direction 37 in a space formed between fitting portion insulator 20 and slide cam 22.

As described above, in the second floating connector 103, the slide cam 22 is urged in the removing direction of the mating connector and is held by the fitting portion insulator 20 to be movable in the first direction 28. The stopper 25 is held by and fixed to the fixed insulator 40. When the slide cam 22 protrudes in the removing direction of the mating connector, a part of the stopper 25 enters into the fitting portion insulator 20 and another part is exposed outside to be brought into contact with a side wall portion of the fixed insulator 40.

When the slide cam 22 is located on a side opposite to the fitting direction 26 of the mating connector 102, a part of the stopper 25 enters into the movable insulator 30, shown in FIG. 1B. When unlocked, a whole of the stopper 25 enters into the fitting portion insulator 20.

In the second floating connector 103, the cam groove 24 of the third guide 29 has an L shape but may be an R shape or an arc shape. In the latter case, the above-mentioned locking is performed in the first and the third directions 28 and 37 before fitting. Upon fitting, the slide cam 22 is pressed and moved towards the center in the second direction 36. By the above-mentioned movement of the slide cam 22, the stopper 25 is rotated. By the rotation of the stopper 25, the locking is released so as to allow floating in the first direction 28 and the third direction 37.

Either of the first and the second floating connectors described above is suitable as a floating connector used in a small portion susceptible to vibration, such as a connector connected to a SATA connector of an HDD.

While the present invention has thus far been described in connection with a few preferred embodiments thereof, it will readily be possible for those skilled in the art to put this invention into practice in various other manners. Although the description is made about the floating control mechanism provided at a light side of the floating connector, it is a matter of course that the floating control mechanism may be provided at both sides of the floating connector. Although a plurality of signal contacts are illustrated, a single signal contact may be used in the floating connector.

What is claimed is:

1. A floating connector comprising:

a fitting portion;

a fixed portion;

a supporting mechanism connected to the fitting portion and the fixed portion to support the fitting portion to the fixed portion so that the fitting portion has a floating allowed in a first direction including a fitting direction of a mating connector; and a floating control mechanism between the fitting portion and the fixed portion for locking the floating when the mating connector is not fitted to the floating connector and for enabling the floating in response to a fitting operation of the mating connector to the floating connector, wherein the floating control mechanism comprises:

a slide cam movable in the first direction; and a stopper engaged with the slide cam and the fitting portion, the floating having a locked state and an enabled state switched to each other following the movement of the slide cam, the floating being locked on the locked state but enabled on the enabled state.

2. The floating connector according to claim 1, wherein the stopper is rotated following the movement of the slide cam, the stopper locking the floating when the mating connector is not fitted, the slide cam being pressed by the mating connector to rotate the stopper when the mating connector is fitted, thereby enabling the floating.

3. A floating connector comprising:

a fitting portion;

a fixed portion;

a supporting mechanism connected to the fitting portion and the fixed portion to support the fitting portion to the fixed portion so that the fitting portion has a floating allowed in a first direction including a fitting direction of a mating connector; and a floating control mechanism between the fitting portion and the fixed portion for locking the floating when the mating connector is not fitted to the floating connector and for enabling the floating in response to a fitting operation of the mating connector to the floating connector, wherein the supporting mechanism comprises a contact being plate-like and having flexibility, the contact being fixed to the fitting portion and to the fixed portion, the contact having a fixed part longer than an unfixed part in its longitudinal direction.

4. The floating connector according to claim 3, wherein the fitting portion has a fitting portion insulator, the contact having a shape folded back at its end near the fitting portion, the contact having a base portion and a folded portion held by the fitting portion insulator.

5. The floating connector according to claim 4, wherein the contact has a spring contact formed at the folded portion, the contact having a back-surface metal to be connected to the mating connector when the mating connector is fitted.

6. The floating connector according to claim 3, wherein the supporting mechanism further comprises an additional contact having flexibility, the contact being fixed to the fitting portion and to the fixed portion, the additional and the first-mentioned contacts being arranged in an array, each of the additional and the first-mentioned contacts being provided with a metal plate disposed on its one side to serve as a ground with an insulator interposed between the contacts and the metal plate.

* * * * *